United States Patent [19]

Terragnoli

[11] 4,015,492

[45] Apr. 5, 1977

[54] MUFFIN SLICER AND PERFORATOR

[76] Inventor: John Terragnoli, 103 Wallace Ave., Buffalo, N.Y. 14214

[22] Filed: Feb. 5, 1976

[21] Appl. No.: 655,555

[52] U.S. Cl. ..... 83/2; 83/4; 83/12

[51] Int. Cl.[2] ..... B26D 3/08

[58] Field of Search ..... 83/4, 2, 6, 9, 12; 225/96

[56] References Cited

UNITED STATES PATENTS

| | | | |
|---|---|---|---|
| 2,235,546 | 3/1941 | Ahrndt | 83/4 |
| 2,520,000 | 8/1950 | Dettman | 83/6 |
| 2,783,803 | 3/1957 | Weckel et al. | 83/2 |
| 3,192,976 | 7/1965 | Clock | 225/96 X |

*Primary Examiner*—Willie G. Abercrombie
*Attorney, Agent, or Firm*—Raymond F. Kramer

[57] ABSTRACT

A machine is described for partially slicing or perforating baked goods such as muffins, buns, and the like, whereby the muffin is either perforated or cut, but not entirely, to facilitate handling in production operations and to provide a sliced or perforated product, as demanded by consumers, that will adhere together until the muffin is ready to be broken apart prior to toasting or eating. The pre-sliced or perforated muffin is produced by automatically guiding the muffins from a production conveyor line into either a series of blades for making the perforations or into a cutting wheel for pre-slicing which can be adjusted to pre-slice the muffins to form a uniform top and bottom section thereof and a uniform depth of cut predetermined to provide a desirable size lip on one end of the muffin to hold the top and bottom sections together. The invented machine may be mounted onto a production conveyor belt by means of a framework and is provided with two drive motors and a serrated disk for either slicing the muffins or for selectively guiding the baked goods through the series of knife blades for forming perforations and back onto the production line conveyor after the baked goods are cut.

9 Claims, 5 Drawing Figures

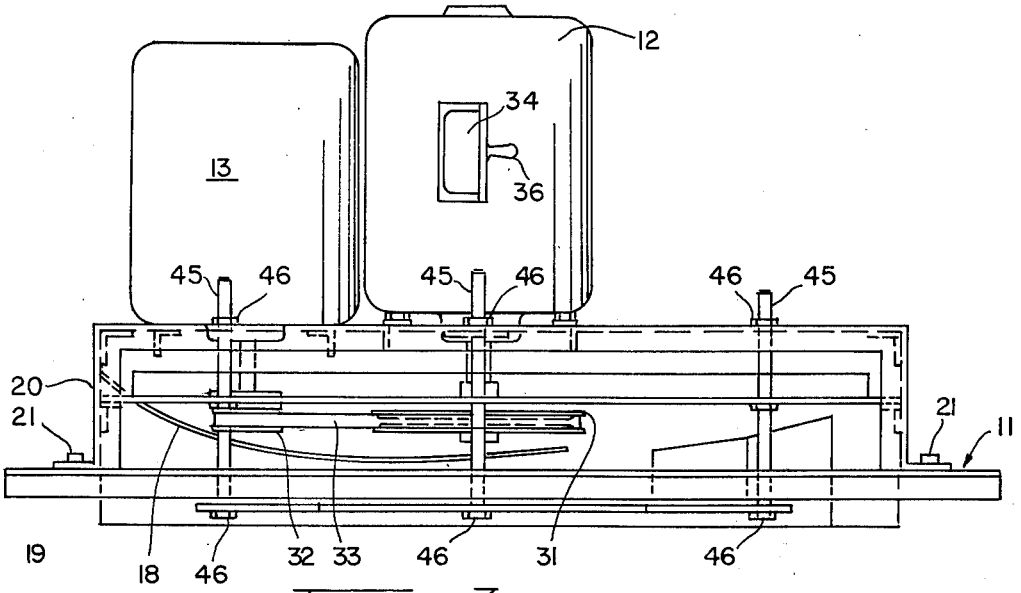
FIG. 3
FIG. 4
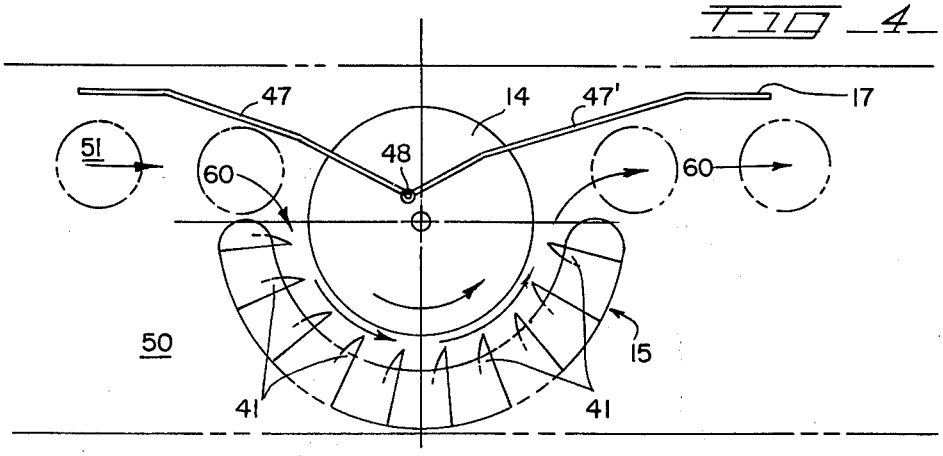
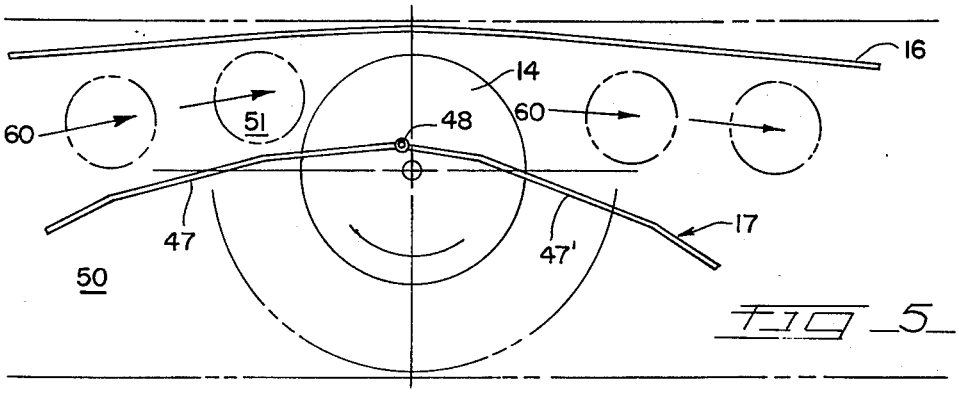
FIG. 5

MUFFIN SLICER AND PERFORATOR

BACKGROUND OF THE INVENTION

1. Field of the Invention

This invention relates to a production machine for pre-slicing or perforating of baked goods such as muffins, buns and the like in a controlled manner.

2. Description of the Prior Art

It has long been recognized that consumers generally prefer pre-sliced or perforated muffins or similar baked goods because slicing by hand causes an inconvenience to the consumer and very often uneven slices are made so that, particularly when toasting the sliced muffins, the muffin will either not fit into a conventional toaster aperture or the product may be charred in one part and underdone in another. Machines for pre-slicing or perforating muffins and similar products are described in the prior art but they are usually complex in structure and often pre-slice or perforate the baked product in an unsatisfactory manner. For example, Swedish Pat. No. 145,284 (1961) discloses a rusk roll slicing device that splits the roll into two separate and distinct pieces and then separates the top half of the roll from the bottom half to complete the split for delivery of both halves as separate units to the consumer. U.S. Pat. No. 2,979,095 (1961) also shows a fully automatic muffin splitting machine which likewise delivers a separated muffin to the consumer. U.S. Pat. No. 3,733,942 (1973) discloses a muffin perforating machine but does not provide for pre-slicing of muffins or similar baked goods. U.S. Pat. 3,669,165 (1972) describes a machine for making pre-sliced English muffins wherein the muffin is pre-sliced by means of a plurality of series arranged rotating cutter disks so that the slicing of the muffin is made in a series of successive cuts, this device being complicated in structure and expensive to manufacture and, because the muffins must pass through a series of rotating blades, often resulting in uneven slices.

There is, then, an obvious need in the marketplace for a production muffin slicer and perforator that is economical to manufacture and that will produce a uniformly pre-sliced or perforated muffin for use by the consumer.

SUMMARY OF THE INVENTION

The present invention provides a novel muffin slicer and perforator for the per-slicing of baked goods such as muffins, buns, and the like, for use in production operations wherein the muffin may be sliced or perforated in an even and uniform manner to provide a uniform top and bottom section thereof but without separating the top from the bottom of the muffin.

It is a feature of the present invention to provide a muffin slicer and perforator.

A further feature of the present invention is to provide a muffin slicer and perforator which is easy to use and reliable and efficient in operation.

Another feature of the present invention is to provide a muffin slicer and perforator which is of a rugged and durable construction and which, therefore, may be guaranteed by the manufacturer to withstand rough and continual usage.

An additional feature of the present invention is the provision of a muffin slicer and perforator for production operations which is relatively simple in construction and which, therefore, may be economically produced by the manufacturer.

Other features of this invention will be apparent from the following description.

BRIEF DESCRIPTION OF THE DRAWINGS

In the accompanying drawings, which form a part of this specification and in which like reference characters are employed to designate like parts throughout the same:

FIG. 3 is a side elevational view of the muffin slicer and perforator;

FIG. 4 is a simplified top plan view of the invented machine showing adjustable guide means and cutting blades in perforating position; and FIG. 5 is a simplified top plan view of the machine showing guide means and cutting wheel in slicing position.

DESCRIPTION OF THE PREFERRED EMBODIMENT

Figure 1:
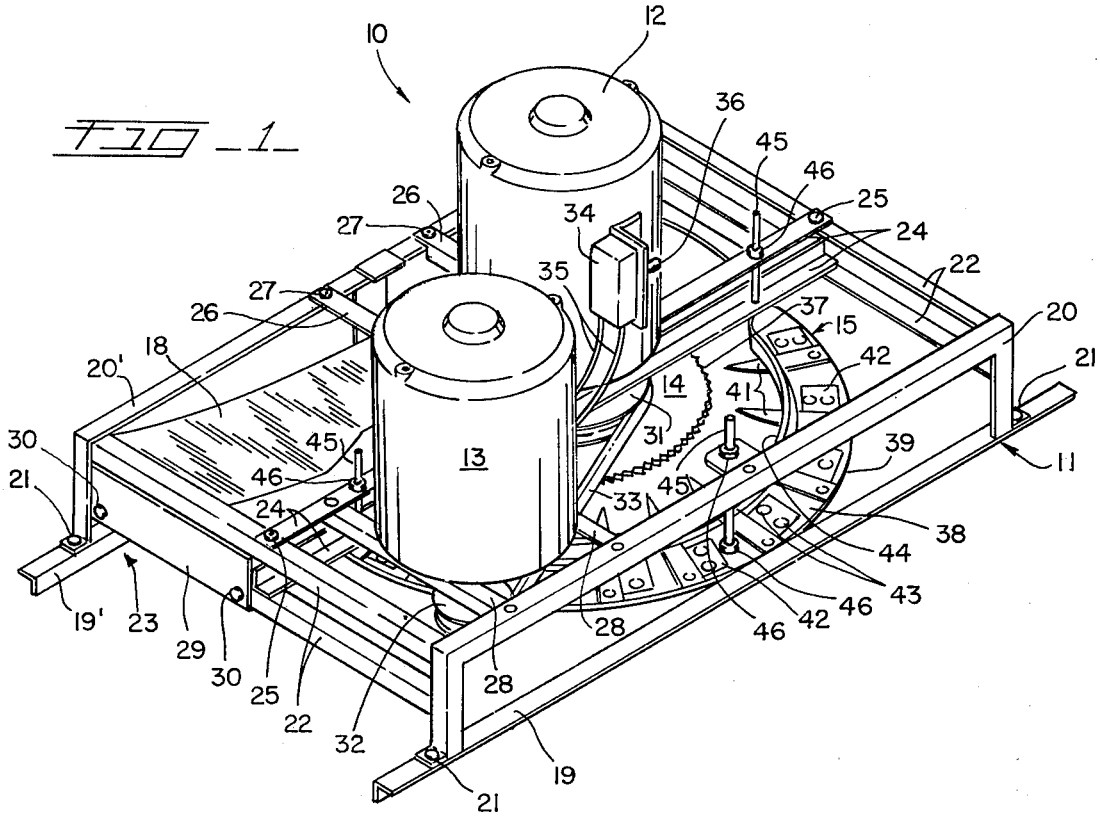
FIG. 1 is a perspective view of the muffin slicer and perforator, including framework for mounting onto a production line conveyor, drive motors, muffin guide plates, slicing blade and perforating

Referring now to the drawings in detail, there is illustrated a preferred form of the muffin slicer and perforator constructed in accordance with the principles of the present invention, which is designated generally in its entirety by the reference numeral 10 and which is comprised of a framework 11, a main drive motor 12, an auxiliary drive motor 13, a circular cutting wheel 14, a multi-blade cutter assembly 15, a stationary guide 16, an adjustable guide 17, a tension strip 18 and associated hardware and components as will be described later.

Figure 2:
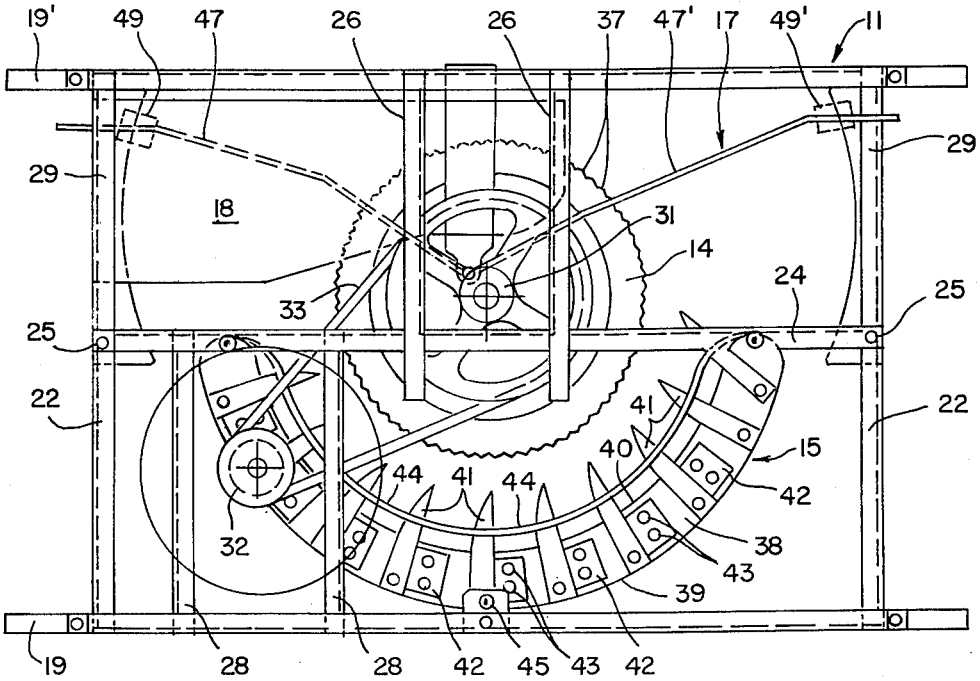
FIG. 2 is a top plan view of the muffin slicer and perforator, with some parts removed and others shown (although hidden) to improve illustration.

The framework 11 is constructed of durable material, such as steel, and includes two lengths of angle iron bottom supports 19 and 19' which are spaced parallel to each other at a distance required to span a production conveyor line (not shown) and which are mounted onto the conveyor line in any conventional way. As shown in FIGS. 1 and 3, two elongated U-shaped frame members 20 and 20'are secured along the length of the bottom supports 19 and 19' respectively to provide a raised elevation therealong with the U-shaped members 20 and 20' being secured to the bottom supports 19 and 19' in a conventional manner by means of a series of bolts 21 and nuts (not shown). The U-shaped members 20 and 20' are interconnected perpendicularly by four cross members 22 which are securely affixed, such as by welding, to the top corners of the U-shaped members 20 and 20' and along their vertical sides to provide a vertical spacing 23 between the bottom of the framework 11 or the production line conveyor belt and the cross members 22, with the U-shaped members 20 and 20' and the cross members 22 being interconnected to form rectangular box like constructions. The cross members 22 are secured together centrally along their lengths on each side of the U-shaped members 20 and 20' by means of the center members 24 in a conventional way, such as by means of nuts 25 and bolts (not shown) on each end of the center members 24. As shown in FIGS. 1 and 2, two main drive motor support brackets 26 are secured by means of bolts 27 and nuts (not shown) perpendicular to and spaced apart between the U-shaped member 20'and the center member 24 to provide support for the main drive motor 12. Also, two auxiliary drive motor support brackets 28 are similarly provided between U-shaped member 20 center member 24 off center and toward one end of the framework 11. Finally, a support plate 29 is assembled by means of the bolts 30 and nuts (not shown) to each end of the framework 11 to close up the gap between the cross members 22 at the feed and exit portions of the framework 11 and to cover up the portion of the framework adjacent to the tension strip 18.

The main drive motor 12 is a conventional electric motor which is connected directly to drive pulley 31 and the circular cutting wheel 14. The auxiliary drive motor 13 is a conventional 1,725 RPM electric motor and is connected to drive pulley 32. Drive pulley 31 is of a larger diameter than drive pulley 32 and they are interconnected by means of a conventional type belt, such as V-belt 33. A toggle switch assembly 34 is provided in a conventional manner on the side of the housing of the main drive motor 12 and is interconnected to the motors 12 and 13 and to a power supply in a conventional way by means of the wires or cables 35. The toggle switch 36 is a 3-way switch with one position for off, another position for activation of the main drive motor 12, and a third position for activation of the auxiliary drive motor 13.

The circular cutting wheel 14 is constructed of durable material, such as steel, and consists of a circular disk with saw-tooth type serrations 37 provided around its circumference, with the circular cutting wheel 14 being securely affixed at its center to the main drive motor 12.

The multi-blade cutter assembly 15, as shown in FIGS. 1 and 2, consists of an arched support plate 38 having an outside curved edge 39 and an inside curved edge 40. A series of knife blades 41 is secured along the length of the arched support plate 38 so that the pointed edges of the knife blades 41 are provided protrudingly along the inside curved edge 40, with the knife blades 41 being secured to the arched support plate by means of a series of mounting plates 42 which are fastened to the arched support plate 38 by means of bolts 43 and nuts (not shown). Stationary guide strip 44 is securely mounted along the top and bottom of the knife blades 41 to run at a preset distance along the inside curved edge 40 of the arched support plate 38 to provide a predetermined protrusion of the knife blades 41 externally from the stationary guide strip 44. The multi-blade cutter assembly 15 is secured to the framework 11 by means of the threaded rods 45 and the nuts 46 as shown in FIGS. 1 and 3.

Stationary guide 16 consists of a narrow strip of durable material, such as steel, and is provided along the length of the U-shaped member 20'. It is bowed to provide a predetermined spacing between the circular cutting wheel 14 and the stationary guide 16. The adjustable guide 17 consists of two narrow strips 47 and 47', being swivelly hinged together at ends thereof by means of the pivot hinge 48 and being supported on their opposite ends by means of the counterweights 49 and 49' respectively, which in turn fit against the support plates 29 on each side of the framework 11.

As shown in FIGS. 1, 2, and 3, the tension strip 18 consists of an irregularly shaped length of material, such as sheet metal, and is arched in configuration to form a larger opening at the point where it is attached to the framework 11 and a smaller vertical opening toward the center of the framework 11.

In operation, the muffin slicer and perforator 10 is assembled to a baked goods production line conveyor by assembling the bottom supports 19 and 19'along the railings of the conveyor line in any conventional way. When it is desired to perforate muffins or similar products, the multi-blade cutter assembly 15 is adjusted vertically by means of the threaded rods 45 and nuts 46 to provide the desired height of the knife blades 41 from the top surface of the conveyor line 50. The adjustable guide 17 is then adjusted, as shown in FIG. 4, with the strips 47 and 47' positioned away from the multi-blade cutter assembly 15 and toward the opposite end of the framework 11. The toggle switch 36 is positioned to activate the auxiliary drive motor 13 so that, from a top view of the muffin slicer and perforator 10, the circular cutting wheel 14 is turned in a counterclockwise direction, and the muffins 51 or similar products, traveling in the direction of the arrows in FIG. 4, as shown by the reference numeral 60, enter the muffin slicer and perforator 10 and are guided along the strip 47 into the circular cutting wheel 14, which acts as a friction wheel to force the muffins 51 toward the inside curved edge 40 of the multi-blade cutter assembly 15 and simultaneously to rotate the muffins 51 and to pierce or perforate the muffins by means of the knife blades 41, with the perforations being predetermined in depth by means of the stationary guide 44, and with the muffins exiting from the muffin slicer and perforator 10 along the strip 47' of the adjustable guide 17. When slicing muffins, the adjustable guide 17 is positioned as shown in FIG. 5 with the strips 47 and 47' being positioned opposedly to the stationary guide 16 and toward the multi-blade cutter assembly 15. The toggle switch 36 is positioned to activate the main drive motor 12 so that, from a top view of the muffin slicer and perforator 10, the circular cutting wheel 14 rotates in a clockwise direction. The muffins 51 are then forced between the strip 47 and the stationary guide 16 and are forced along the stationary guide 16 where they are sliced by means of the circular cutting wheel 14, leaving an unsliced portion of the muffin 51 as determined by the spacing between the circular cutting wheel 14 and the stationary guide 16.

There is thus described a muffin slicing and perforating machine which combines the flexibility of choice of either slicing or perforating operations and which is simple in construction and economical to produce. The machine thereby meets all its stated objectives and overcomes the disadvantages of existing equipment.

It is to be understood that the form of this invention as shown and described is to be taken as a preferred example thereof and that this invention is not to be limited to the exact arrangement of parts described in the description or illustrated in the drawing, as changes in the details thereof pertaining to size, shape and arrangement of parts are within the scope of the invention and do not depart from the novel concepts thereof.

Having thus described the invention, what is claimed is:

1. A combination muffin slicer and perforator which can be easily adjusted for either perforating or slicing baked goods, such as muffins, buns, and the like, for use on a bakery production line comprising, in combination:

A rigid framework which is attachable to a production line conveyor by means of two parallel bottom supports, two U-shaped elongated members attached in a conventional way to each of the bottom supports, the U-shaped members being further rigidly connected by a series of cross members attached perpendicularly to the U-shaped members to form a box-like structure, a set of center members being interconnected perpendicularly to the centers of the cross members, and a series of support brackets interconnected in a conventional way between the U-shaped members and the center members to provide support for the drive motors;

A main drive motor and an auxiliary drive motor with each of the drive motors being operated independently by means of a 3-way toggle switch;

A circular cutting wheel integrally attached to the drive shaft of the main drive motor with the circular cutting wheel being provided with serrated saw-like teeth around its perimeter, with the circular cutting wheel being usable alternatively for slicing muffins and the like or as a friction wheel when perforating muffins and the like;

A multi-blade cutter assembly consisting of an arched support plate to which a series of knives is affixed along its inside radius and being further provided with a stationary guide to regulate the depth of perforations into the baked goods, and with th multi-blade cutter assembly being ertically adjustable to perforate the baked goods at the desired plane from the production line conveyor by means of a series of threaded rods and nuts;

A stationary guide against which the muffins are guided during slicing thereof to provide the desirable depth of cut into the baked goods;

An adjustable guide consisting of two hingeably attached strips to regulate the flow of the baked goods on the production line conveyor into either the slicing or perforating apparatus; and A tension strip securely attached to the framework to forcibly hold the baked goods in position on the conveyor line during a slicing operation.

2. A muffin slicer and perforator as set forth in claim 1 wherein the adjustable guide is provided with counterweights on both ends for slidably adjusting the adjustable guide within support plates affixed to said framework of the machine.

3. A muffin slicer and perforator as set forth in claim 1 wherein the main drive motor is activated by a toggle switch to rotate the cutting wheel in a clockwise direction for slicing operations and the auxiliary drive motor is separately activated by the same toggle switch in another position to turn the cutting wheel in a counterclockwise direction by means of a pulley and belt attachment to the main drive motor and the cutting wheel thereby acts as a friction wheel to force the baked goods into the multi-blade cutter assembly for perforating muffns and the like.

4. A muffin slicing and perforating machine as set forth in claim 1 wherein the perforating knives are secured to the inside radius of an arched support plate by means of a series of mounting plates attached to said support plate by a series of bolts and nuts to provide easy removal or replacement of said knives for maintanance purposes.

5. A muffin slicer and perforator as set forth in claim 1 wherein the muffins or other similar baked goods are fed into the machine on a production line conveyor via the same opening or point of entry into the machine for either slicing or perforating operations.

6. A muffin slicer and perforator as set forth in claim 1 which is bridged over a production line conveyor belt so that, by varying the dimension between the bottom support plates and associated mechanisms, it can be adapted to any bakery conveyor belt system.

7. A machine for selectively perforating and slicing baked goods, such as muffins and buns, adapted to be mounted on a conveyor of a baked goods production line which delivers such baked goods to the machine and removes them from it, which comprises perforating means, slicing means, means for directing the baked goods selectively into contact with the perforating means or the slicing means so as to perforate and slice said goods, a framework and motor driving means for the slicing means, in which the perforating means includes a plurality of perforating knives mounted on a support and arranged so that when the baked goods are being perforated they travel along a path past said knives so that they are pierced and perforated by said knives in such manner as to make separation of halves of the individual baked goods readily effected, the slicing means includes a cutting wheel adapted to slice the baked goods when said goods are passed past the cutting wheel and the selectively directing means includes a guide for selective movement into a position wherein forward movement of the conveyor selectively moves the baked goods past the perforating means or past the slicing means, depending on the position of the guide with respect to the conveyor supporting surface.

8. A machine according to claim 7 wherein the cutting wheel is circular and has serrations or saw-like teeth about its perimeter, which cut the baked goods when said goods are passed past the cutting wheel for cutting when the wheel is turned at a higher speed, which cutting wheel, when turned at a lower speed, serves as a friction wheel when the baked goods are passed past the perforating knives, pressing them against and past such knives, and in which speed control means for controlling speed of the cutting-friction wheel are provided so that said wheel may be operated at higher and lower speeds, respectively, depending on whether the baked goods are to be sliced or perforated.

9. A machine according to claim 8, adapted for selectively perforating and slicing English muffins, which comprises means for controlling the height of slicing and perforating by the slicing and perforating means, means for controlling the depth of slicing by the slicing means, means for controlling the depth of perforating by the perforating means, and in which the motor driving means for the cutting-friction wheel is directly attached to said wheel and the adjustable guide is of two hingedly attachment strips movable by hinged movement substantially transversely across at least part of the conveyor belt on hich the machine is mounted and having means at ends thereof for maintaining them in slidably adjusted positions to direct the muffins selectively past the cutting wheel and the perforating knives, and which includes an auxiliary motor indirectly attached to the cutting-friction wheel for running said wheel at a lower speed than that provided by the directly attached motor, so that when the muffins are to be perforated the wheel acts as a friction wheel rotating in a direction which advances the muffins as they are perforated and when the muffins are to be sliced said wheel acts as a cutting wheel and rotates in the opposite direction, and switch means for selectively activating the motors and for inactivating them.

* * * * *